US009845570B2

(12) United States Patent
McNamee et al.

(10) Patent No.: US 9,845,570 B2
(45) Date of Patent: Dec. 19, 2017

(54) METHOD FOR MANUFACTURING A DYE SCAVENGING SUBSTRATE

(71) Applicant: Henkel AG & Co. KGaA, Duesseldorf (DE)

(72) Inventors: Patrick McNamee, Rochestown Country Cork (IE); Lauriane Le Guerledan, Cork (IE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/046,642

(22) Filed: Feb. 18, 2016

(65) Prior Publication Data

US 2016/0160438 A1 Jun. 9, 2016

Related U.S. Application Data

(63) Continuation of application No. PCT/EP2014/058951, filed on May 1, 2014.

(30) Foreign Application Priority Data

Aug. 20, 2013 (GB) ..... 1314895.2

(51) Int. Cl.
*D06M 13/328* (2006.01)
*D06P 5/22* (2006.01)
(Continued)

(52) U.S. Cl.
CPC ..... *D06P 5/22* (2013.01); *C11D 3/0021* (2013.01); *C11D 3/30* (2013.01); *C11D 17/041* (2013.01);
(Continued)

(58) Field of Classification Search
CPC .... D06M 13/385; D06M 23/00; D06M 13/11; D06M 13/47; D06M 2101/06;
(Continued)

(56) References Cited

U.S. PATENT DOCUMENTS 3,778,225 A 12/1973 Cuvelier et al.
4,380,453 A 4/1983 Claiborne
6,117,191 A * 9/2000 McNamee ..... C11D 1/62 8/188

FOREIGN PATENT DOCUMENTS

EP 2014754 A2 1/2009
WO 96/26831 A1 9/1996
(Continued)

OTHER PUBLICATIONS

STIC Search Report dated May 17, 2016.*
PCT International Search Report (PCT/EP2014/058951) dated Jul. 31, 2014.

*Primary Examiner* — Eisa Elhilo
(74) *Attorney, Agent, or Firm* — Thomas G. Krivulka

(57) ABSTRACT

A method for manufacturing a dye scavenging substrate which comprises the steps of: (a) providing an absorbent substrate; (b) passing the substrate through a bath containing an alkaline solution of a dye scavenging compound selected from: (i) a N-trisubstituted ammonium-2-hydroxy-3-halo-propyl compound having the general formula (I), or (ii) a salt of epoxy propyl ammonium having the general formula (II), or a combination thereof; (c) subjecting the substrate to a pressure of from about 0.04 MPa to about 0.40 MPa; (d) wrapping the substrate in a water impermeable material and rotating the substrate for a period of from about 12 hours to about 60 hours; (e) removing the water impermeable material and passing the substrate through a bath containing an acid solution; (f) subjecting the substrate to a pressure of from about 0.15 MPa to about 0.40 MPa; and (g) drying the substrate.

15 Claims, 3 Drawing Sheets

(51) Int. Cl.

| | |
|---|---|
| ***D06M 13/385*** | (2006.01) |
| ***D06M 13/463*** | (2006.01) |
| ***D06M 13/525*** | (2006.01) |
| ***D06M 23/00*** | (2006.01) |
| ***D06M 13/11*** | (2006.01) |
| ***D06M 13/47*** | (2006.01) |
| ***C11D 3/00*** | (2006.01) |
| ***C11D 3/30*** | (2006.01) |
| ***C11D 17/04*** | (2006.01) |
| *D06M 101/06* | (2006.01) |

(52) U.S. Cl.
CPC ..... *C11D 17/049* (2013.01); *D06M 13/11* (2013.01); *D06M 13/385* (2013.01); *D06M 13/463* (2013.01); *D06M 13/47* (2013.01); *D06M 13/525* (2013.01); *D06M 23/00* (2013.01); *D06M 2101/06* (2013.01); *D10B 2201/02* (2013.01); *D10B 2201/24* (2013.01); *D10B 2401/14* (2013.01)

(58) Field of Classification Search
CPC .. D06M 13/463; C11D 17/049; C11D 3/0021; C11D 17/041; C11D 3/30; D10B 2201/24; D10B 2201/02; D10B 2401/14; D06P 5/22
See application file for complete search history.

(56) References Cited

FOREIGN PATENT DOCUMENTS

| | | |
|---|---|---|
| WO | 97/48789 A1 | 12/1997 |
| WO | 02/33040 A1 | 4/2002 |

* cited by examiner

METHOD FOR MANUFACTURING A DYE SCAVENGING SUBSTRATE

FIELD OF THE INVENTION

The present invention generally relates to a method for manufacturing a dye scavenging substrate.

BACKGROUND OF THE INVENTION

It is well known that a typical mix of articles in a laundry wash will have somewhat different colors, even if sorted into the so-called "white" and "colored" batches. Although fading of dyes is more prevalent from new, unlaundered, or heretofore infrequently laundered goods, even articles with considerable fastness to washing, or having a long history of numerous previous launderings, may continue to bleed small amounts of dyestuff or colorant into the bath or wash water. The well known, but aggravating and undesirable result of such fading is that at least part of the extraneous, free flowing dyestuff which has bled from its original material article may then be absorbed, adsorbed, reacted with, or otherwise physically deposited on or associated with other articles in the same wash liquor, thus discoloring this latter item.

Attempts to solve this problem have included treating the dyes or colorants so that they have a greater affinity for the dyed material. Attempts have also been made to eliminate dyestuffs discharged in the wash water. International PCT Patent Publication No. WO-A-97/48789 discloses a method of controlling undesirable dye or colorant discharged in wash water, comprising placing in the wash a dye scavenging substrate which when added to the wash scavenges and absorbs extraneous dye. WO-A-97/48789 also discloses a method of manufacturing the dye scavenging substrate.

It is an object of the present invention to provide an alternative method for manufacturing a dye scavenging substrate.

It is a further object of the present invention to provide an improved method for manufacturing a dye scavenging substrate, which method results in the dye scavenging substrate having improved dye scavenging capabilities.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A method for manufacturing a dye scavenging substrate which comprises the steps of: providing an absorbent substrate; passing the substrate through a bath containing an alkaline solution of a dye scavenging compound selected from: a N-trisubstituted ammonium-2-hydroxy-3-halopropyl compound having the general formula (I):

(I)

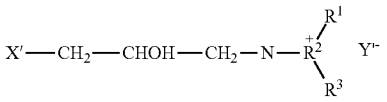

wherein $R^1$, $R^2$, $R^3$ are each independently methyl, ethyl, butyl, benzyl or an hydroxyl substituted derivative thereof, X' is a halogen atom, and $Y'^-$ is chloride, bromide, sulfate or sulfonate; or a salt of epoxy propyl ammonium having the general formula (II):

(II)

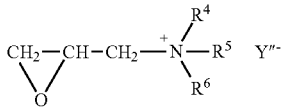

wherein $R^4$, $R^5$, $R^6$ and $Y''^-$ have the same meaning as $R^2$, $R^3$ and $Y'^-$, respectively, as defined above, or a combination thereof; subjecting the substrate to a pressure of from about 0.04 MPa to about 0.40 MPa; wrapping the substrate in a water impermeable material and rotating the substrate for a period of from about 12 hours to about 60 hours; removing the water impermeable material and passing the substrate through a bath containing an acid solution; subjecting the substrate to a pressure of from about 0.15 MPa to about 0.40 MPa; and drying the substrate.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
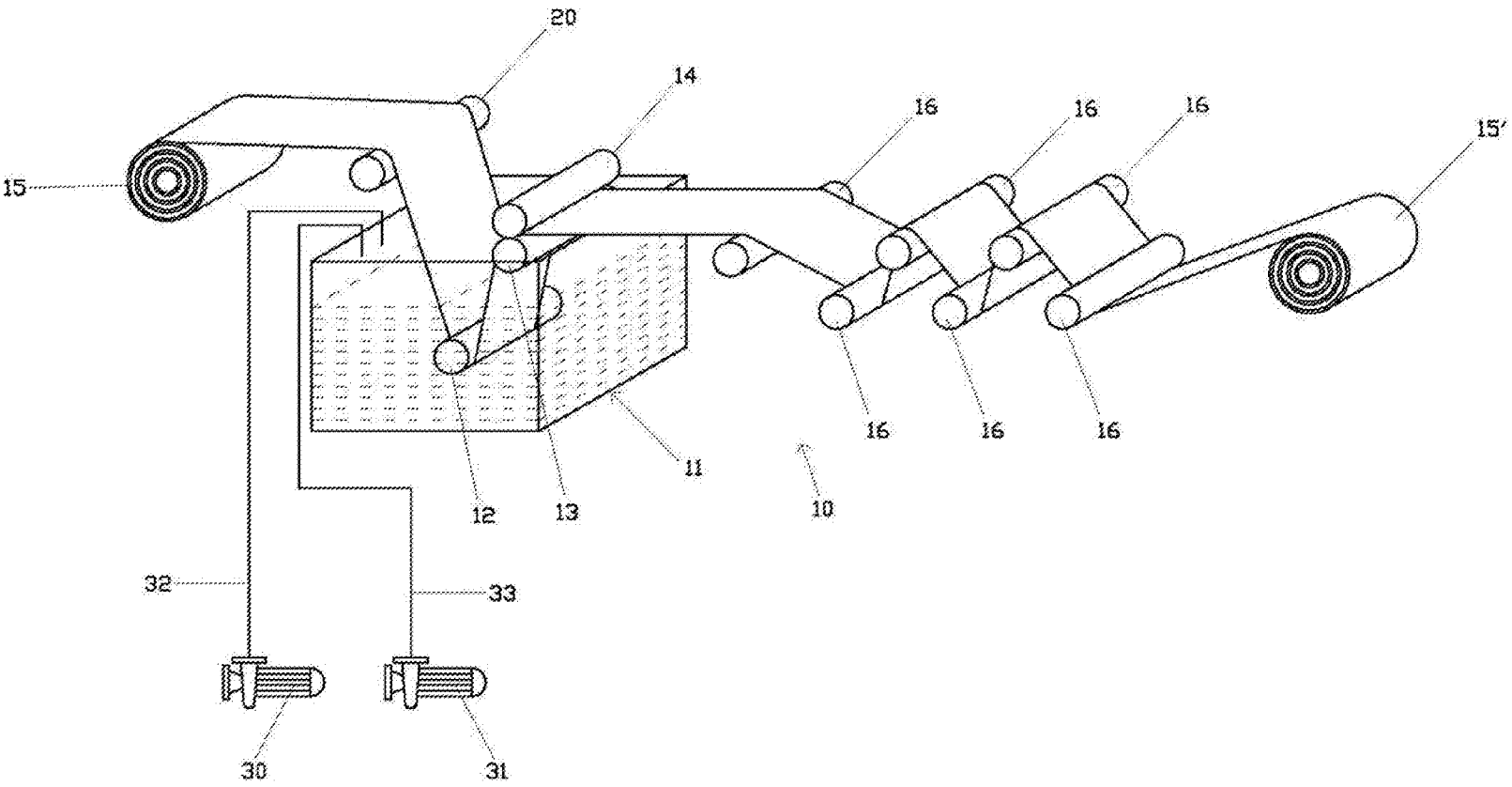
FIG. 1 is a schematic view of a first part of an apparatus for use in the method according to the invention.

The following detailed description of the invention is merely exemplary in nature and is not intended to limit the invention or the application and uses of the invention. Furthermore, there is no intention to be bound by any theory presented in the preceding background of the invention or the following detailed description of the invention.

The invention provides a method for manufacturing a dye scavenging substrate which comprises the steps of:

(a) providing an absorbent substrate;

(b) passing the substrate through a bath containing an alkaline solution of a dye scavenging compound selected from:

(i) a N-trisubstituted ammonium-2-hydroxy-3-halopropyl compound having the general formula (I)

(I)

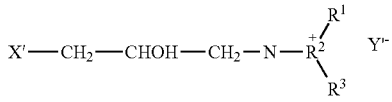

wherein $R^1$, $R^2$, $R^3$ are each independently methyl, ethyl, butyl, benzyl or an hydroxyl substituted derivative thereof, X' is a halogen atom, and $Y'^-$ is chloride, bromide, sulfate or sulfonate;

or (ii) a salt of epoxy propyl ammonium having the general formula (II)

(II)

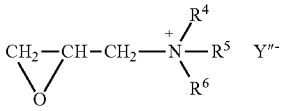

wherein $R^4$, $R^5$, $R^6$ and $Y''^-$ have the same meaning as $R^2$, $R^3$ and $Y'^-$, respectively, as defined above, or a combination thereof;

(c) subjecting the substrate to a pressure of from about 0.04 MPa to about 0.40 MPa;

(d) wrapping the substrate in a water impermeable material and rotating the substrate for a period of from about 12 hours to about 60 hours;

(e) removing the water impermeable material and passing the substrate through a bath containing an acid solution;

(f) subjecting the substrate to a pressure of from about 0.15 MPa to about 0.40 MPa; and (g) drying the substrate.

Preferably, in step (b), the alkaline solution comprises a basic solution comprising water and a base, preferably NaOH. Preferably, the basic solution comprises water and the base in a respective ratio by weight of from about 10:90 to about 50:50, preferably from about 20:80 to about 40:60, more preferably about 30:70. Most preferably, the basic solution is a 30% solution of NaOH available under the trade name Caustic Soda Liquor from Micro-Bio (Ireland) Ltd, Industrial Estate, Fermoy, County Cork, Ireland.

The compound is preferably a salt of epoxy propyl ammonium having the general formula (II), preferably glycidyltrimethylammonium chloride, also known as (2,3-epoxypropyl)trimethylammonium chloride, available in solid form or as a 72% aqueous solution from Sigma Aldrich, wherein $R^4$, $R^5$, $R^6$ are each methyl and $Y''^-$ is chloride.

The alkaline solution preferably comprises the compound and the basic solution in a respective ratio by weight of from about 1:0.42 to about 1:0.83, preferably from about 1:0.56 to about 1:0.69, more preferably about 1:0.59. It will be appreciated that these ratios preferably refer to the compound in solid form. Optionally, when the compound is provided as a 72% solution, the alkaline solution preferably comprises the compound and the basic solution in a respective ratio by weight of about 1:0.42.

Alternatively, the compound may be a compound of formula (I), for example 3-chloro-2-hydroxypropyltrimethylammonium chloride, available from Sigma Aldrich, wherein $R^1$, $R^2$, $R^3$ are each methyl, X' is chlorine, and $Y'^-$ is chloride.

Preferably, the alkaline solution is at a temperature of from about 10° C. to about 30° C., more preferably about 20° C.

Preferably, in step (c), the pressure is from about 0.05 MPa to about 0.35 MPa, more preferably from about 0.10 MPa to about 0.30 MPa, even more preferably from about 0.10 MPa to about 0.25 MPa, still more preferably from about 0.10 MPa to about 0.20 MPa, even more preferably from about 0.12 MPa to about 0.18 MPa, still more preferably about 0.13 MPa or about 0.14 MPa or about 0.15 MPa or about 0.16 MPa or about 0.17 MPa, most preferably about 0.16 MPa.

Preferably, in step (c), the pressure is obtained by passing the substrate between a pair of rollers, optionally pneumatically actuated rollers. The rollers are preferably nitrile rubber 70 shore hardness type rollers available from Downey Textile Machinery, Spurn Point, Manchester Road, Linthwaite, Huddersfield, West Yorkshire HD7 5RF, United Kingdom. It will, however, be appreciated that any other suitable type of rollers may be used. Step (c) may be carried out on a textile padder, e.g. a textile padder available from Downey Textile Machinery, details provided above, but it will be appreciated that step (c) is not limited to use with this particular apparatus.

Preferably, in step (c), the substrate is passed through the rollers at a speed of from about 10 $m.min^{-1}$ to about 60 $m.min^{-1}$, preferably from about 20 $m.min^{-1}$ to about 60 $m.min^{-1}$, more preferably from about 30 $m.min^{-1}$ to about 60 $m.min^{-1}$, even more preferably from about 40 $m.min^{-1}$ to about 60 $m.min^{-1}$, still more preferably from about 50 $m.min^{-1}$ to about 60 $m.min^{-1}$, especially about 55 $m.min^{-1}$.

Preferably, in step (c), an air manifold is used to maintain constant and consistent air pressure across the substrate, to enable the substrate to pick up a consistent weight of the alkaline solution containing the dye scavenging compound, therefore enabling the substrate to demonstrate a consistent and repeatable dye scavenging performance. It will be appreciated that any suitable conventional air manifold may be used. The air manifold may be provided as part of the textile padder. However, it will be appreciated that the invention is not limited thereto.

Preferably, in step (d), the substrate is rotated for a period of from about 24 hours to about 60 hours, more preferably from about 24 hours to about 48 hours, still more preferably from about 30 hours to about 48 hours, even more preferably from about 36 hours to about 48 hours, even more preferably from about 42 hours to about 48 hours, still more preferably about 43 or 44 or 45 or 46 or 47 or 48 hours, most preferably about 48 hours. This step of rotating the substrate is also known as the curing step.

Preferably, in step (d), the substrate is rotated continuously on a roller. Preferably, in step (d), the temperature (ambient temperature) is from about 10° C. to about 100° C., more preferably from about 10° C. to about 50° C., even more preferably from about 10° C. to about 40° C., even more preferably from about 10° C. to about 30° C., still more preferably from about 15° C. to about 25° C., even more preferably about 20° C.

Preferably, in step (e), the acid solution comprises water and a hydrochloric acid (HCl) solution, preferably a 11.6 M HCl solution. The acid solution preferably has a pH from about 1.5 to about 2.5, more preferably a pH of 2.1. Preferably, a pH probe is placed in the bath containing the acid solution in order to maintain the pH at 2.1. Thus, the pH probe conveniently signals the water requirement and this is dosed when required to give the correct pH automatically.

Preferably, the acid solution is at a temperature of from about 10° C. to about 30° C., more preferably about 20° C.

Preferably, in step (f), the pressure is from about 0.20 MPa to about 0.35 MPa, still more preferably from about 0.25 MPa to about 0.35 MPa, even more preferably from about 0.28 MPa to about 0.33 MPa, still more preferably about 0.29 MPa or about 0.30 MPa or about 0.31 MPa or about 0.32 MPa, most preferably about 0.30 MPa.

Preferably, in step (f), the pressure is obtained by passing the substrate between a pair of rollers, optionally pneumatically actuated rollers. The rollers are preferably nitrile rubber 70 shore hardness type rollers available from Downey Textile Machinery, details provided above. It will, however, be appreciated that any other suitable type of rollers may be used. Step (f) may be carried out on a textile padder, e.g. a textile padder available from Downey Textile Machinery, details provided above, but it will be appreciated that step (f) is not limited to use with this particular apparatus.

Preferably, in step (f), the substrate is passed through the rollers at a speed of from about 10 $m.min^{-1}$ to about 60 $m.min^{-1}$, preferably from about 20 $m.min^{-1}$ to about 60 $m.min^{-1}$, more preferably from about 30 $m.min^{-1}$ to about 60 $m.min^{-1}$, even more preferably from about 40 $m.min^{-1}$ to about 60 $m.min^{-1}$, still more preferably from about 50 $m.min^{-1}$ to about 60 $m.min^{-1}$, especially about 55 $m.min^{-1}$.

Preferably, in step (f), an air manifold is used to maintain constant and consistent air pressure across the substrate, to enable a consistent amount of liquid (neutralizing acid solution) to be squeezed from the substrate, thereby enabling the substrate to demonstrate a consistent and repeatable performance. It will be appreciated that any suitable conventional air manifold may be used. The air manifold may be provided as part of the textile padder. However, it will be appreciated that the invention is not limited thereto.

Without limiting the invention thereto, the minimum pressure in step (f) is preferably higher than the minimum pressure in step (c), as in step (c), it is desirable to retain liquid (the alkaline solution containing the dye scavenging compound), to allow the liquid to react on the substrate, whereas in step (f), it is desirable to remove the liquid (the acid solution used to neutralize the alkaline solution containing the dye scavenging compound), prior to drying the substrate.

Preferably, in step (g), the drying temperature is from about 95° C. to about 125° C., preferably from about 100° C. to about 120° C., most preferably about 115° C. Optionally, in step (g), the substrate is dried by passing the substrate along one or more drying cylinders, which drying cylinders are optionally at a temperature of from about 95° C. to about 125° C., preferably from about 100° C. to about 120° C., most preferably about 115° C. The drying cylinders may be drying cylinders sold under the trade name Prichard available from Downey Textile Machinery, details provided above, but it will be appreciated that the invention is not limited thereto.

Optionally, after step (f) and prior to step (g), the method may comprise one or more of the additional steps of (f)(i)-(f)(iv):

(f)(i) passing the substrate through a first fresh water rinse;

(f)(ii) subjecting the substrate to a pressure of from about 0.10 MPa to about 0.30 MPa;

(f)(iii) passing the substrate through a second fresh water rinse; and (f)(iv) subjecting the substrate to a pressure of from about 0.10 MPa to about 0.30 MPa.

Thus, in one aspect, the method may comprise all steps (a)-(f), (f)(i)-(f)(iv), and (g).

Preferably, in steps (f)(i) and (f)(iii), when present, the first and second fresh water rinses take the form of a bath containing water, optionally at a temperature of from about 10° C. to about 30° C., preferably about 20° C.

Preferably, in steps (f)(ii) and (f)(iv), when present, the pressure is obtained by passing the substrate between a pair of rollers, optionally pneumatically actuated rollers. Details of suitable rollers are provided above, but it will be appreciated that the invention is not limited thereto. Preferably, the pressure is approximately 0.2 MPa. The substrate is preferably passed through the rollers at a speed of from about 10 $m.min^{-1}$ to about 60 $m.min^{-1}$, preferably from about 20 $m.min^{-1}$ to about 60 $m.min^{-1}$, more preferably from about 30 $m.min^{-1}$ to about 60 $m.min^{-1}$, even more preferably from about 40 $m.min^{-1}$ to about 60 $m.min^{-1}$, still more preferably from about 50 $m.min^{-1}$ to about 60 $m.min^{-1}$, especially about 55 $m.min^{-1}$.

The absorbent substrate may be formed from any suitable material, and may be woven or non-woven. Examples of suitable materials include cellulosic materials such as viscose, cotton, wood pulp, paper, and mixtures thereof. The material may comprise a naturally occurring material or a synthetic material or a mixture thereof. In an embodiment, the substrate may comprise a blend of viscose and cotton in a ratio by weight in the range of from about 70:30 to about 30:70, optionally from about 60:40 to about 40:60, further optionally about 50:50. The absorbent substrate may comprise a binder such as polyvinylacetate. A suitable substrate may be a substrate comprising viscose and cotton in a 50:50 ratio by weight, and optionally including a binder, as disclosed for example in International PCT Patent Publication No. WO-A-97/48789. However, it will be appreciated by a skilled person that the substrate is not limited to being made from the above-listed materials, and be made from any other suitable material(s), cellulosic or otherwise.

The dye scavenging compound (I) and/or (II) is preferably present in an amount of from about 4.4 g to about 5.5 g, more preferably from about 4.6 g to about 5.1 g, most preferably about 4.9 g per square meter of absorbent substrate.

The dimensions of the substrate, once cut for use in a domestic wash, are approximately 25 cm×12 cm. It will, however, be appreciated that any other suitable dimensions may be used. The amount of dye scavenging compound (I) and/or (II) provided on a 25 cm×12 cm substrate is preferably from about 0.13 g to about 0.17 g, more preferably from about 0.133 g to about 0.16 g, even more preferably from about 0.138 g to about 0.153 g, most preferably about 0.150 g.

The absorbent substrate material preferably has a weight of from about 40 $g/m^2$ to 200 $g/m^2$, more preferably from about 55 $g/m^2$ to 80 $g/m^2$, most preferably approximately 60 $g/m^2$ or 70 $g/m^2$.

The rollers used in the method of the invention are preferably nitrile rubber 70 shore hardness type rollers available from Downey Textile Machinery, details provided above.

Advantages of the invention include the following, but are not limited thereto:

It has surprisingly been found that using reduced pressure in step (c) and increased curing (rotation) time in step (d), compared with the pressure (0.69 MPa to 1.37 MPa) and curing time (1 hour to 12 hours) disclosed in International PCT Patent Publication No. WO-A-97/48789, results in a dye scavenging substrate which performs significantly better in terms of dye pick-up. Accordingly, it is proposed that the inventors have surprisingly discovered an optimum pressure and curing time that provides the resultant dye scavenging substrate with improved dye pick-up results while also maintaining good tensile strength.

It will be appreciated by a skilled person that only the pressure range in step (c) and curing time in step (d) are essential to achieve the improved results. Without wishing to be bound by theory, it is proposed that the pressure in step (c) is essential as it allows a sufficient amount of the dye scavenging compound (provided in the alkaline solution) to be retained on the substrate; and the curing time in step (d) is essential as it allows sufficient time for the dye scavenging compound to react with the substrate to produce superior dye scavenging results, without allowing the tensile strength to be affected.

It will be appreciated by a skilled person that the method of the invention is not limited to use with a cellulosic substrate, and that any other suitable absorbent substrate may be used in order to show the improvement in dye scavenging capabilities achieved using the method of the invention.

Figure 2:
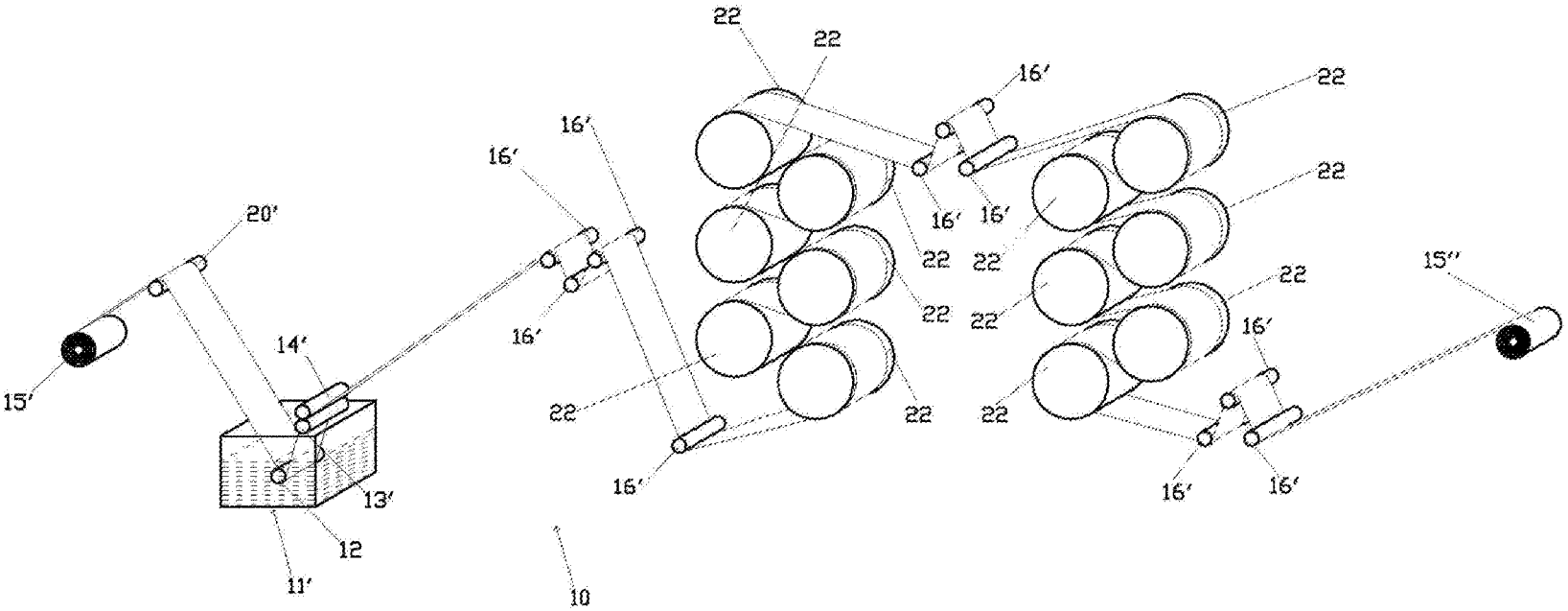
FIG. 2 is a schematic view of a second part of the apparatus shown in FIG. 1.
Figure 3:
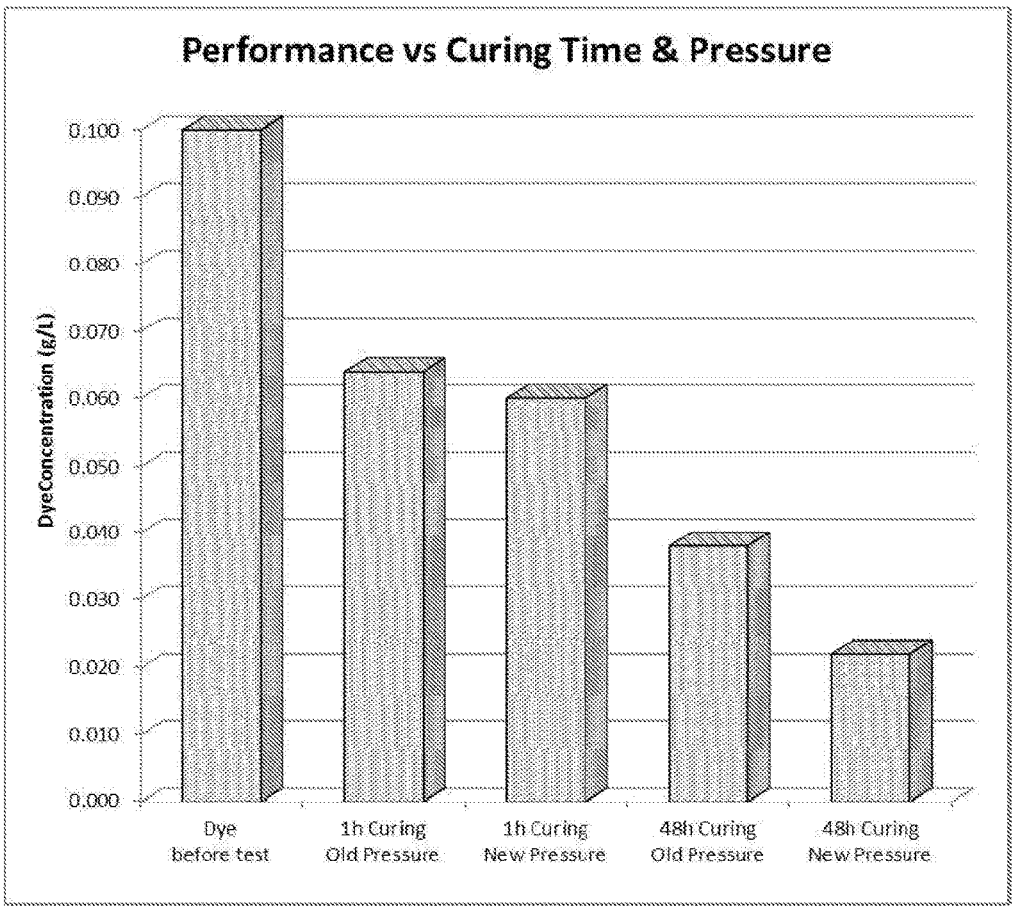
FIG. 3 shows the results of a comparative test carried out to investigate the dye pick-up performance of a dye scavenging substrate prepared in accordance with the method of the invention.

The invention will now be described in greater detail, with reference to the accompanying non-limiting examples and drawings, in which:

FIG. 1 is a schematic view of a first part of an apparatus for use in the method according to the invention;

FIG. 2 a schematic view of a second part of the apparatus shown in FIG. 1; and FIG. 3 shows the results of a comparative test carried out to investigate the dye pick-up performance of a dye scavenging substrate prepared in accordance with the method of the invention.

Referring now to FIG. 1, there is shown a first part of an apparatus 10 for use in the method of the invention which comprises a bath 11 containing rollers 12, 20, a pair of pneumatically operated rollers 13, 14, and a series of rollers 16.

The method is generally carried out as follows. A roll of absorbent substrate 15 is loaded onto a roller bar (not shown) of the first part of the apparatus 10. The substrate 15 is then fed via roller 20 into the bath 11 so as to pass beneath the roller 12 and out of the bath 11 to between the rollers 13, 14. By means of pump 30, the bath 11 is charged with a basic solution as described above, via line 32. By means of pump 31, the bath 11 is charged with a dye scavenging compound solution as described above, via line 33. The rollers 13, 14 are set to provide a pressure of from about 0.04 MPa to about 0.40 MPa.

The substrate 15 then passes along the series of rollers 16 along a convoluted pathway to finally emerge therefrom to be taken up by a take-up roller (not shown) so as to provide a partially treated substrate roll 15'.

The partially treated substrate roll 15' is then removed from the apparatus 10, wrapped in a water impermeable material, replaced on the take-up roller, and rotated continuously on the take-up roller at a temperature of from about 10° C. to about 100° C. for a period of from about 12 hours to about 60 hours. This step of rotating the partially treated substrate roll 15' is referred to as the curing step. The water impermeable material may be a water impermeable film, for example derived from regenerated cellulose, such as Cellophane (trade mark), for example Cellophane available from Innovia Films Ltd, Wigton, Cumbria, United Kingdom.

Referring now to FIG. 2, there is shown a second part of the apparatus 10, in which like components have been accorded like reference numerals and unless otherwise stated perform a like function to the components shown in FIG. 1.

Once the curing step is complete, the partially treated substrate roll 15' is unwound from the take-up roller onto a roller bar (not shown) and then onto the roller 20' of the second part of the apparatus 10. The substrate 15' is fed via roller 20' into the bath 11' so as to pass beneath the roller 12', and out of the bath 11' to between the pneumatically operated rollers 13', 14'. The bath 11' is charged with an acid solution as described above, by means of a pump (not shown) via a line (not shown). The substrate 15' then passes along the series of rollers 16' and drying cylinders 22 along a convoluted pathway to finally emerge therefrom to be taken up by a take-up roller (not shown) to provide a treated substrate roll 15", being the dye scavenging substrate. The drying cylinders 22 are preferably at a temperature of from about 95° C. to about 125° C., to facilitate drying of the treated substrate 15". The thus produced substrate 15" is now stored and cut into appropriately sized pieces, preferably 25 cm×12 cm.

The substrate is preferably passed through the first and second parts of the apparatus 10 at a speed of from about 10 $m.min^{-1}$ to about 60 $m.min^{-1}$.

It will be appreciated that the second part of the apparatus 10 may be adapted to include a series of two baths containing water so as to provide first and second fresh water rinses. The one or more baths would be provided as part of the apparatus 10 after the bath 11' and before the rollers 16', so that the substrate 15' on leaving the bath 11' would pass between the rollers 13', 14' and then into a first bath containing water (not shown), out of the first bath and between a first set of pneumatically operated rollers (not shown), then into a second bath containing water (not shown), out of the second bath and between a second set of pneumatically actuated rollers (not shown). In this variation, the substrate would then pass along the series of rollers 16' and drying cylinders 22 along the convoluted pathway to finally emerge and be taken up by the take-up roller (not shown) to provide a treated substrate roll 15", being the dye scavenging substrate. It will be appreciated by a skilled person that the fresh water rinses do not affect the resultant substrate in any substantial way, but serve to remove the odor of the dye scavenging compound.

The method may be carried out on any textile padder, for example a textile padder available from Downey Textile Machinery, details provided above, but it will be appreciated that the method of the invention is not limited to use with this particular apparatus.

Example 1

A dye scavenging substrate was prepared as follows. A roll of cellulosic substrate 15 was loaded onto a roller bar (not shown) of the first part of the apparatus 10 (FIG. 1), and fed via roller 20 into the bath 11, at a speed of 55 $m.min^{-1}$. The bath 11 contained an alkaline solution comprising a 30% solution of NaOH available under the trade name Caustic Soda Liquor from Micro-Bio (Ireland) Ltd, and (2,3-epoxypropyl)trimethylammonium chloride (72% solution) available from Sigma Aldrich, in a respective ratio by weight of 0.42:1. The alkaline solution was at a temperature of 20° C. The substrate 15 was passed beneath the roller 12 in the bath, then out of the bath 11 and between the pair of pneumatically actuated rollers 13, 14 set to provide a pressure of 0.16 MPa. The substrate 15 was then passed along the series of rollers 16 along a convoluted pathway to finally emerge therefrom and be taken up by a take-up roller (not shown) so as to provide a partially treated substrate roll 15'. The partially treated substrate roll 15' was removed from the apparatus 10, wrapped in Cellophane (trade mark), replaced on the take-up roller, and rotated continuously on the take-up roller at a temperature of about 20° C. for a period of 48 hours (the curing step). After 48 hours, the substrate 15' was loaded onto a roller bar (not shown) of the second part of the apparatus 10 (FIG. 2), and fed via roller 20' into the bath 11', at a speed of 55 $m.min^{-1}$. The bath 11' contained an acid solution comprising a solution of 11.6 M HCl with water to give a pH of 2.1. The acid solution was at a temperature of 20° C. The substrate 15' was passed beneath the roller 12' in the bath 11', then out of the bath 11' and between the pair of pneumatically actuated rollers 13', 14' set to provide a pressure of 0.30 MPa. The substrate 15' was then passed through the series of rollers 16' and drying cylinders 22, operating at a temperature of 115° C. The substrate 15' was then taken up by a take-up roller (not shown) to provide the treated substrate roll 15", being the dye scavenging substrate. The thus produced substrate 15" was then stored and cut into pieces measuring 25 cm×12 cm, and bearing about 0.15 g of dye scavenging compound per cut substrate.

The method described in this example was carried out using a textile padder available from Downey Textile Machinery, details provided above. However, it will be appreciated that the invention is not limited to use with this particular apparatus.

Example 2

The following comparative test was performed in order to investigate the dye pick-up performance of a dye scavenging substrate prepared in accordance with the method of the invention.

A solution of dye in water having a dye concentration of 0.100 g/L was prepared. The performance of substrates prepared in accordance with different methods, including the method of the invention, was investigated. The substrates used were as follows.

X. Substrate (25 cm×12 cm) prepared in accordance with the invention in Example 1 above, i.e. using a pressure in step (c) of 0.16 MPa ("new pressure") and rotated (cured) for 48 hours.

A. Substrate (25 cm×12 cm) prepared using a pressure in step (c) of 1.03 MPa (pressure according to WO 97/48789, "old pressure") and rotated (cured) for 1 hour, i.e. a difference in pressure and curing time.

B. Substrate (25 cm×12 cm) prepared using a pressure in step (c) of 0.16 MPa ("new pressure") and rotated (cured) for 1 hour, i.e. a difference in curing time.

C. Substrate (25 cm×12 cm) prepared using a pressure in step (c) of 1.03 MPa (pressure according to WO 97/48789, "old pressure") and rotated (cured) for 48 hours, i.e. a difference in pressure.

Substrate X was placed in the dye solution for a period of 3 minutes, following which the substrate was removed and the dye concentration was measured using a spectrophotometer DR3900 available from Hach, Willstatterstr. 11, D-40549 Dusseldorf, Germany. The process was then repeated separately for each of the remaining substrates A, B and C, using a fresh dye solution having a dye concentration of 0.100 g/L for each test. These tests were repeated three times and averages taken. The results are shown in Table 1 and in FIG. 3.

TABLE 1

| | Dye solution before test | A | B | C | X |
|---|---|---|---|---|---|
| Pressure | — | "Old pressure" 1.03 MPa | "New pressure" 0.16 MPa | "Old pressure" 1.03 MPa | "New pressure" 0.16 MPa |
| Curing Time (rotation of substrate) | — | 1 hour | 1 hour | 48 hours | 48 hours |
| Remaining dye (g/L) after 3 min test | 0.100 | 0.064 | 0.060 | 0.038 | 0.022 |

Referring to Table 1, the lower the resultant dye concentration after 3 minutes, the better the result, as the lower value indicates that the substrate in question had scavenged more dye from the dye solution which is indicative of its effectiveness at picking up loose dye in a laundry wash. It is clear from the results shown in Table 1 that substrate X, prepared in accordance with the invention in Example 1, displayed far superior dye pick-up results compared with the substrate A, prepared in using the pressure (1.03 MPa) and curing time (1 hour) of the prior art (disclosed e.g. in the Example of International PCT Patent Publication No. WO-A-97/48789). Substrate X also displayed far superior dye pick-up results compared with substrates B and C in which only one of pressure or curing time was adjusted compared to the prior art (disclosed in e.g. the Example of WO-A-97/48789). Without wishing to be bound by theory, it is proposed that a surprising synergy is achieved by the reduced pressure and increased curing time used in the method of the present invention, thereby producing an unexpected technical effect of significantly improved dye pick-up.

Example 3

The following comparative test was performed in order to investigate the tensile strength of a dye scavenging substrate prepared in accordance with the method of the invention.

All of the substrates in this Example were prepared using a pressure of 0.16 MPa in step (c) ("new pressure"), and varied only in the curing times as indicated. The substrates investigated were as follows:

B. Substrate (25 cm×12 cm) was the same Substrate B as tested in Example 2 above, i.e. rotated (cured) for 1 hour.

D. Substrate (25 cm×12 cm) was rotated (cured) for 12 hours.

E. Substrate (25 cm×12 cm) was rotated (cured) for 24 hours.

X. Substrate (25 cm×12 cm) was the same Substrate X as tested in Example 2 above, i.e. rotated (cured) for 48 hours.

F. Substrate (25 cm×12 cm) was rotated (cured) for 72 hours.

G. Substrate (25 cm×12 cm) was rotated (cured) for 96 hours.

The wet tensile strength of each of the dye scavenging substrates B, D, E, X, F and G was measured as follows. The prepared substrates were submerged in a container of water in order to wet the substrates. Once wet, the wet cross direction (CD) tensile strength of each substrate was measured using a tensile tester A700980 available from Zwick Roell, Southern Avenue, Leominster, Herefordshire HR6 OQH, United Kingdom. The results are shown in Table 2.

TABLE 2

| | B | D | E | X | F | G |
|---|---|---|---|---|---|---|
| Pressure | New | New | New | New | New | New |
| Curing Time | 1 h | 12 h | 24 h | 48 h | 72 h | 96 h |
| Wet CD Tensile Strength (N/m) | 542.9 | 452.3 | 426.6 | 415.7 | 399.3 | 378 |

Referring to Table 2, the lower the value of the wet cross direction (CD) tensile strength, the weaker the substrate. It will be apparent to a skilled person that a value of wet cross direction tensile strength of less than 400 N/m would result in a weak substrate which would be susceptible to tearing and disintegrating in a laundry wash, which is undesirable. Accordingly, it is clear from the results shown in Table 2 that substrate X, prepared in accordance with the invention in Example 1, maintained good tensile strength while exhibiting superior dye pick-up abilities as described in Example 2 above. Indeed all of the substrates D, E and X, prepared by a method according to the invention including a curing time of from 12 to 48 hours, all displayed good tensile strength. It will be appreciated from Table 2 that, although not tested, a substrate prepared by a method according to the invention including a curing time of 60 hours, would also display good tensile strength.

Accordingly, the method of the invention produces a dye scavenging substrate that displays a superior performance in terms of dye pick-up, and yet still maintains good tensile strength in the wash, and is suitable for use in domestic and commercial laundry environments.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for manufacturing a dye scavenging substrate which comprises the steps of:

(a) providing an absorbent substrate;

(b) passing the substrate through a bath containing an alkaline solution of a dye scavenging compound selected from:

(i) a N-trisubstituted ammonium-2-hydroxy-3-halopropyl compound having the general formula (I):

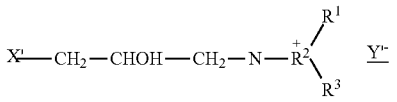

(I)

wherein $R^1$, $R^2$, $R^3$ are each independently methyl, ethyl, butyl, benzyl or an hydroxyl substituted derivative thereof, X' is a halogen atom, and $Y'^-$ is chloride, bromide, sulfate or sulfonate;

or (ii) a salt of epoxy propyl ammonium having the general formula (II):

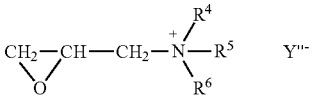

(II)

wherein $R^4$, $R^5$, $R^6$ and $Y''^-$ have the same meaning as $R^2$, $R^3$ and $Y'^-$, respectively, as defined above, or (iii) a combination thereof;

(c) subjecting the substrate to a pressure of from about 0.04 MPa to about 0.40 MPa;

(d) wrapping the substrate in a water impermeable material and rotating the substrate for a period of from about 24 hours to about 60 hours;

(e) removing the water impermeable material and passing the substrate through a bath containing an acid solution;

(f) subjecting the substrate to a pressure of from about 0.15 MPa to about 0.40 MPa; and (g) drying the substrate.

2. A method according to claim 1, wherein in step (c), the pressure is from about 0.05 MPa to about 0.35 MPa.

3. A method according to claim 1, wherein in step (c), the pressure is obtained by passing the substrate between a pair of rollers.

4. A method according to claim 3, wherein in step (c), the substrate is passed through the rollers at a speed of from about 10 $m.min^{-1}$ to about 60 $m.min^{-1}$.

5. A method according to claim 1, wherein in step (d), the substrate is rotated for a period of from about 24 hours to about 48 hours.

6. A method according to claim 1, wherein in step (d), the temperature is from about 10° C. to about 100° C.

7. A method according to claim 1, wherein in step (b), the alkaline solution is at a temperature of from about 10° C. to about 30° C.

8. A method according to claim 1, wherein in step (e), the acid solution comprises water and a hydrochloric acid (HCl) solution.

9. A method according to claim 1, wherein in step (f), the pressure is from about 0.20 MPa to about 0.35 MPa.

10. A method according to claim 1 wherein in step (f), the pressure is obtained by passing the substrate between a pair of rollers.

11. A method according to claim 10, wherein in step (f), the substrate is passed through the rollers at a speed of from about 10 $m.min^{-1}$ to about 60 $m.min^{-1}$.

12. A method according to claim 1, wherein in step (g), the drying temperature is from about 95° C. to about 125° C.

13. A method according to claim 1, wherein in step (b), the compound is glycidyltrimethylammonium chloride.

14. A method according to claim 1, wherein the absorbent substrate is a cellulosic material.

15. A method according to claim 14, wherein the absorbent substrate comprises a blend of viscose and cotton.

* * * * *